US012674599B2

(12) United States Patent
Ortiz

(10) Patent No.: US 12,674,599 B2
(45) Date of Patent: Jul. 7, 2026

(54) VENT GUARDS

(71) Applicant: InOvate Acquisition Company, Jupiter, FL (US)

(72) Inventor: James V. Ortiz, Jupiter, FL (US)

(73) Assignee: INOVATE INC., Jupiter, FL (US)

( * ) Notice: Subject to any disclaimer, the term of this patent is extended or adjusted under 35 U.S.C. 154(b) by 845 days.

(21) Appl. No.: 17/828,622

(22) Filed: May 31, 2022

(65) Prior Publication Data

US 2022/0390144 A1 Dec. 8, 2022

Related U.S. Application Data

(60) Provisional application No. 63/196,052, filed on Jun. 2, 2021.

(51) Int. Cl.
*F24F 13/08* (2006.01)

(52) U.S. Cl.
CPC ..... *F24F 13/084* (2013.01)

(58) Field of Classification Search
CPC ..... F24F 13/084; F24F 13/20; F24F 13/0254; F24F 13/0209; F24F 11/89; F24F 2221/16; F24F 2221/17; F28F 9/002
USPC ..... 454/330, 275, 367, 227, 204
See application file for complete search history.

(56) References Cited

U.S. PATENT DOCUMENTS 3,742,659 A * 7/1973 Drew ..... F24F 13/00 52/27
5,219,403 A * 6/1993 Murphy ..... F24F 13/0236 137/561 A
5,632,678 A * 5/1997 Doelfel ..... F24F 7/02 454/366
5,722,181 A * 3/1998 Meyer ..... D06F 58/20 34/235
7,147,554 B1 * 12/2006 Berger ..... F24F 13/084 454/359
2006/0211363 A1 * 9/2006 Coxon ..... F24F 11/745 454/227
2009/0280737 A1 * 11/2009 Jacak ..... F24F 11/745 454/359
2011/0312262 A1 * 12/2011 Grandmaison ..... F24F 13/084 454/276
2015/0354127 A1 * 12/2015 Ott ..... D06F 58/20 34/235
2019/0226385 A1 * 7/2019 Thibedeau ..... H05K 7/20181

* cited by examiner

*Primary Examiner* — Michael G Hoang
*Assistant Examiner* — Brett P. Mallon
(74) *Attorney, Agent, or Firm* — Troutman Pepper Locke LLP; Gabrielle L. Gelozin

(57) ABSTRACT

A vent guard can include a stationary frame and a cage hinged to the stationary frame at a hinged portion. The cage can be configured to engage to the stationary frame at an engagement structure of the cage to support the cage in a closed position to enclose a vent within the cage. The engagement structure can be configured to be slid relative to the stationary frame.

14 Claims, 10 Drawing Sheets

VENT GUARDS

CROSS-REFERENCE TO RELATED APPLICATIONS

This application claims priority to and the benefit of U.S. Provisional Application No. 63/196,052, filed Jun. 2, 2021, the entire contents of which are herein incorporated by reference in their entirety.

FIELD

This disclosure relates to vent guards (e.g., for dryer vents, bathroom exhausts, kitchen exhausts, or air intakes).

BACKGROUND

Vent guards (e.g., for dryer vents, bathroom exhausts, kitchen exhausts, or air intakes) can act as a cover to prevent animals such as birds from entering and/or nesting in a vent. However, certain guards usually involve a cage structure attached to a rain guard that blocks access to the vent without removal of the vent guard.

Conventional methods and systems have generally been considered satisfactory for their intended purpose. However, there is still a need in the art for improved vent guards. The present disclosure provides a solution for this need.

SUMMARY

A vent guard can include a stationary frame and a cage hinged to the stationary frame at a hinged portion. The cage can be configured to engage to the stationary frame at an engagement structure of the cage to support the cage in a closed position to enclose a vent within the cage. The engagement structure can be configured to be slid relative to the stationary frame.

The hinged portion of the cage can also slidable relative to the stationary frame to allow the entire cage to slide relative to the stationary frame to disengage the cage. The stationary frame can be structured such that the engagement structure of the cage is configured to be freed from the stationary frame by sliding the cage in a first direction, then rotating the cage about the hinged portion.

The stationary frame can include a first side and a second side. The cage can form a front and a bottom of the vent guard. Each side can include an engagement slot defined therein having an elbow shape and configured to receive the engagement structure of the cage. Each side can also include a hinge slot defined therein having a straight shape, and configured to receive the hinge structure.

Each engagement slot can include a first slot portion extending substantially vertical and a second slot portion extending substantially forward from the first slot portion to open to a front of each side. Each second slot portion can be angled downward from a top of the first slot portion toward the front of each side.

The hinge slot can be a single slot that is substantially vertical such that the hinge structure of the cage can slide substantially vertically within the hinge slot as well as rotate within the hinge slot. Each hinge slot can be located at a diagonally opposite corner of each side relative to the engagement slot. For example, each engagement slot can be located in an upper front corner of each side and each hinge slot can be located in a lower rear corner of each side.

The engagement structure of the cage can include a lateral protrusion for each engagement slot. Each lateral protrusion can extend laterally from the cage and be configured to slide within a respective engagement slot to engage and disengage the cage with the stationary frame. In certain embodiments, the engagement structure can be a bar attached extending across a width of the cage.

The hinge structure can include a hinge protrusion disposed through each hinge slot that extends both laterally and axially from each respective side such that each hinge protrusion prevents lateral removal of the cage from each hinge slot. In certain embodiments, the hinge structure can be a bar extending across a width of the cage. In certain embodiments, the engagement structure is a top front bar attached to a plurality of cage bars, and the hinge structure is a bottom rear bar attached to the plurality of cage bars.

The stationary structure can include a slanted roof connecting the first side and the second side together. Any other suitable structure is contemplated herein.

A method can include lifting a cage of a vent guard to slide the cage relative to a fixed structure of the vent guard and rotating the cage of the vent guard relative to the fixed structure to provide access to a vent. Lifting the cage can include lifting the cage at least partially vertically. Rotating the cage can include rotating the cage forward and downward. The method can include performing vent maintenance after opening the cage. The method can include any other suitable method(s) and/or portions thereof.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
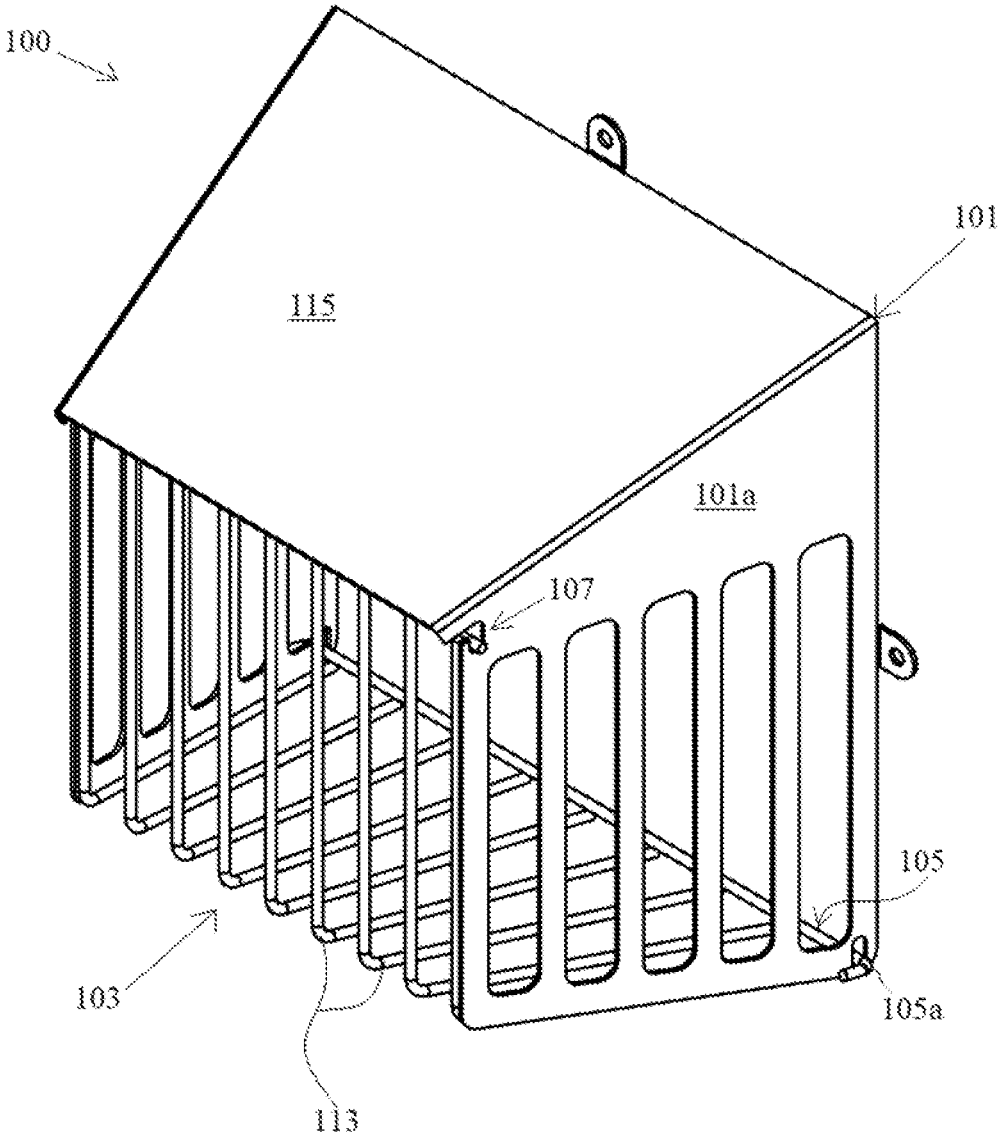
FIG. 1 is a perspective view of an embodiment of a vent guard in accordance with this disclosure, shown having a cage in a closed position.
Figure 2:
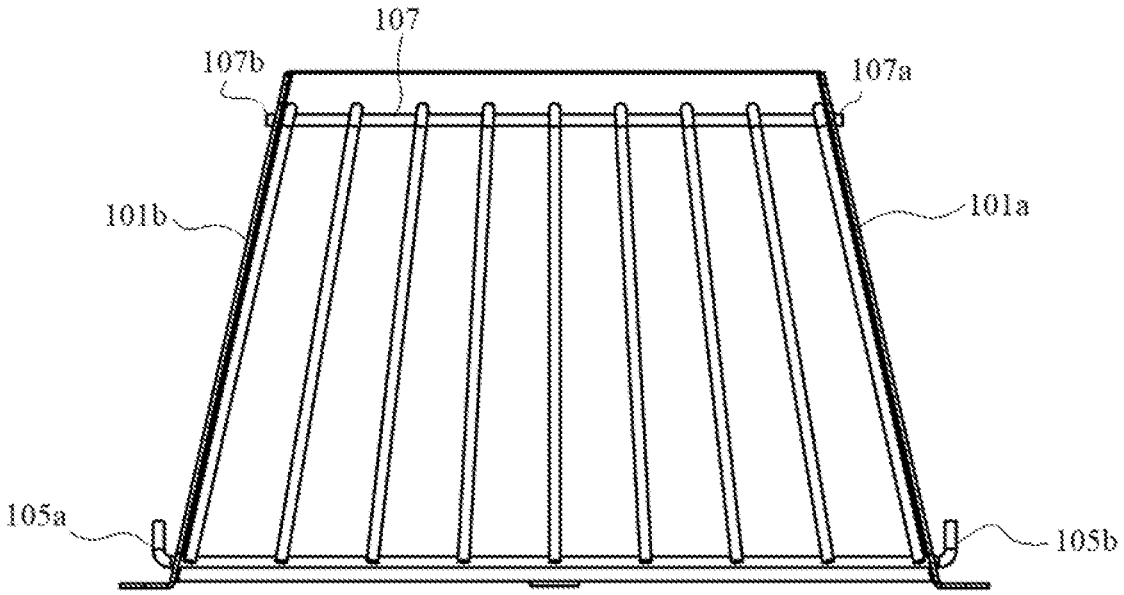
FIG. 2 is a bottom plan view of the embodiment of FIG. 1.
Figure 3:
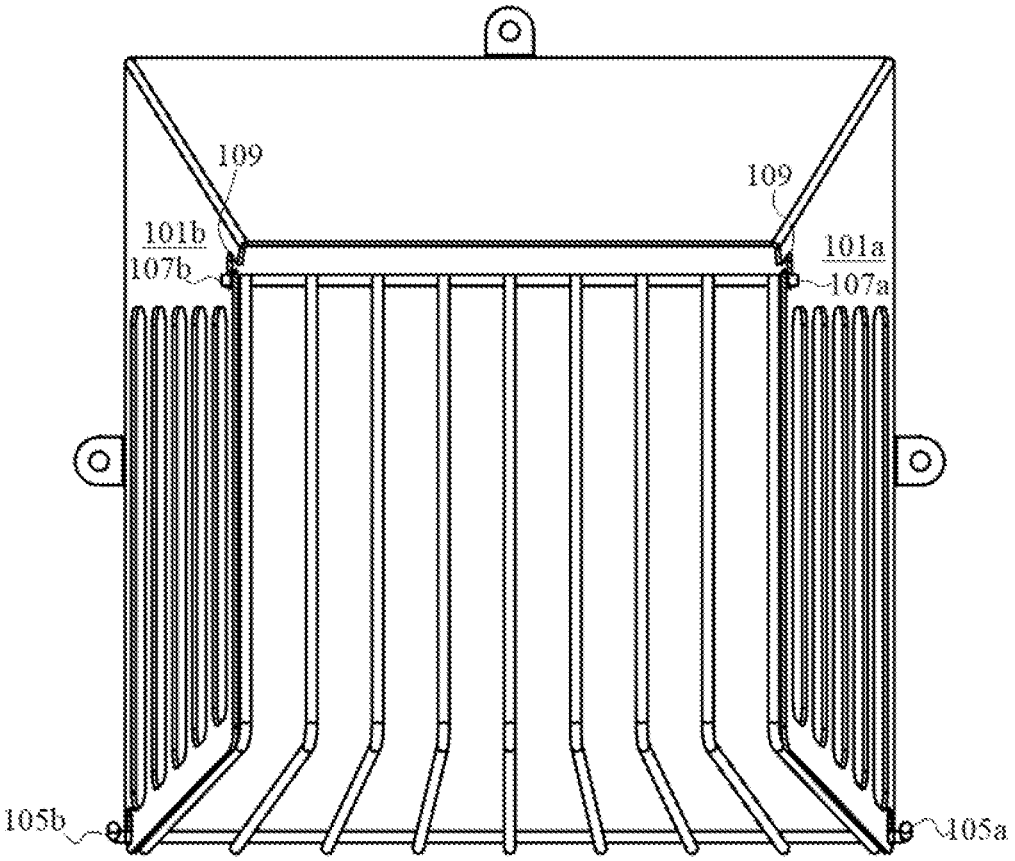
FIG. 3 is a front elevation view of the embodiment of FIG. 1.
Figure 4:
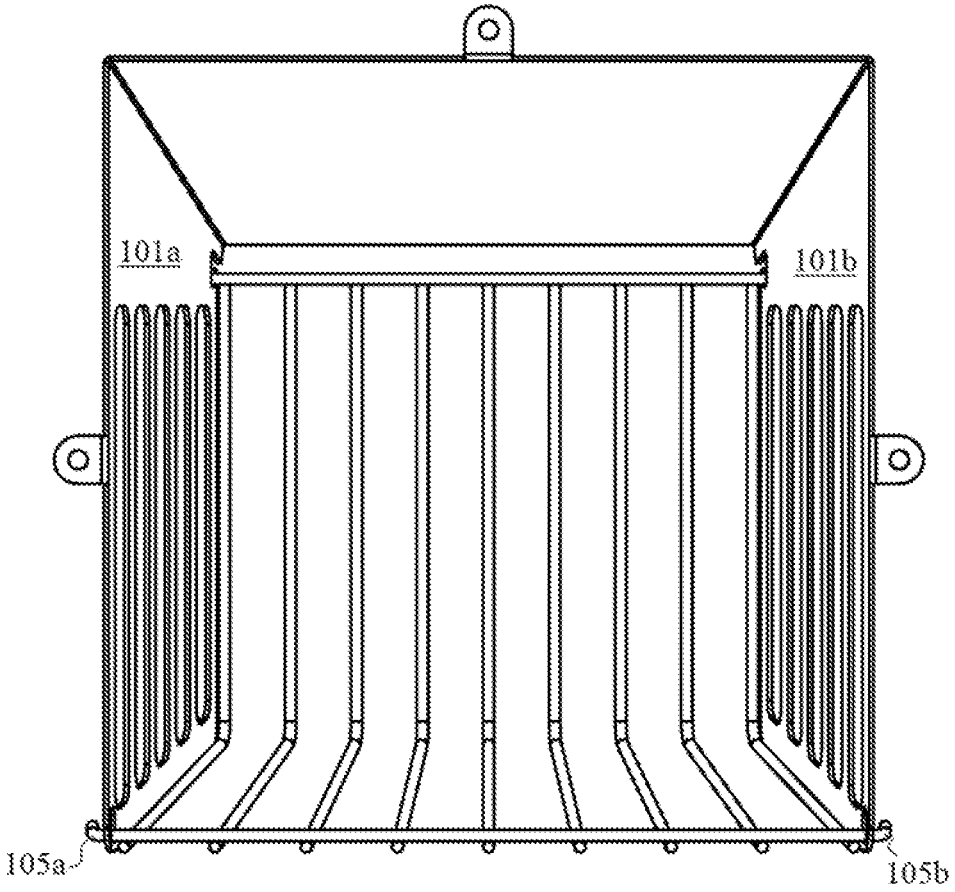
FIG. 4 is a rear elevation view of the embodiment of FIG. 1.
Figure 5:
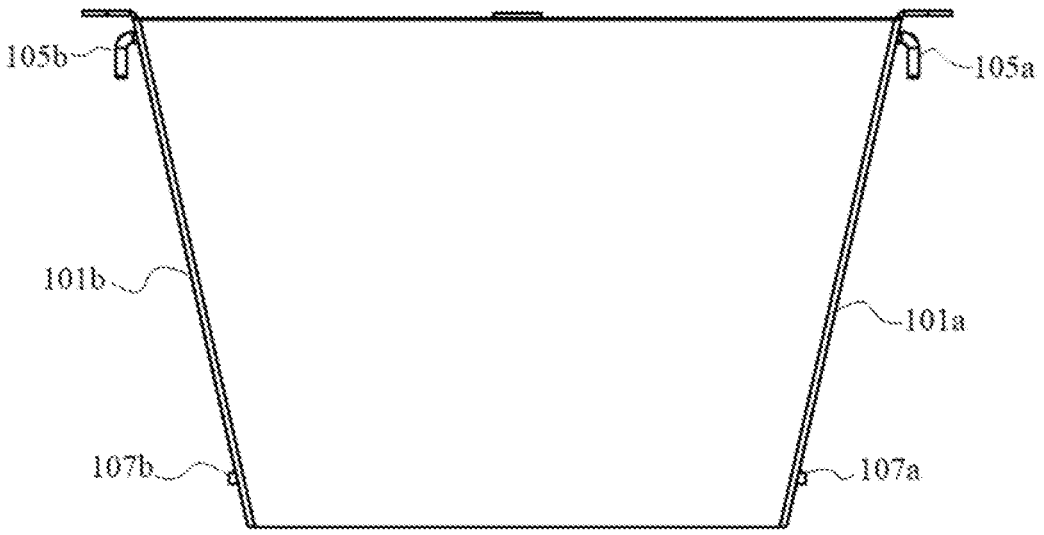
FIG. 5 is a top plan view of the embodiment of FIG. 1.
Figure 6:
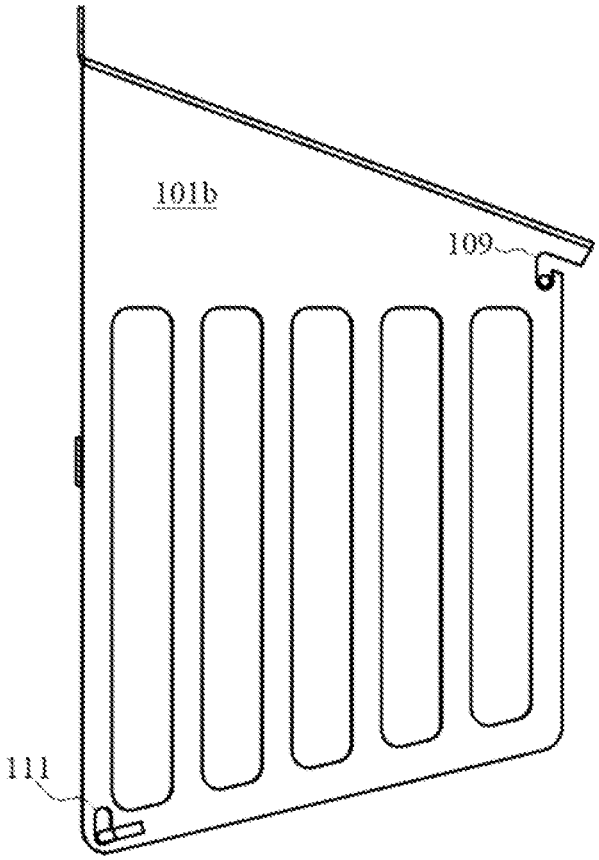
FIG. 6 is a left side elevation view of the embodiment of FIG. 1.
Figure 7:
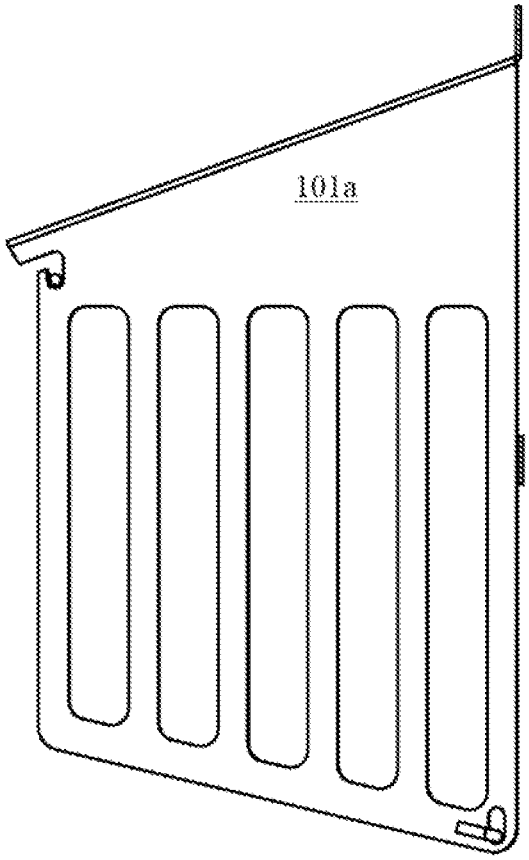
FIG. 7 is a right side elevation view of the embodiment of FIG. 1.

Reference will now be made to the drawings wherein like reference numerals identify similar structural features or aspects of the subject disclosure. For purposes of explanation and illustration, and not limitation, an illustrative view of an embodiment of a vent guard in accordance with the disclosure is shown in FIG. 1 and is designated generally by reference character 100. Other embodiments and/or aspects of this disclosure are shown in FIGS. 2-8C. Certain embodiments described herein can be used to provide vent protection (e.g., for dryer vents, bathroom exhausts, kitchen exhausts, or air intakes) while allowing easy access to the vent, e.g., for inspection and/or maintenance.

Referring to FIGS. 1-8C, a vent guard 100 can include a stationary frame 101 and a cage 103 hinged to the stationary frame 101 at a hinged portion 105. The cage 103 can be configured to engage to the stationary frame 101 at an engagement structure 107 of the cage 103 to support the cage 103 in a closed position (e.g., as shown in FIGS. 1-8A) to enclose a vent (not shown) within the cage 103. The engagement structure 107 can be configured to be slid relative to the stationary frame 101.

Figure 8A:
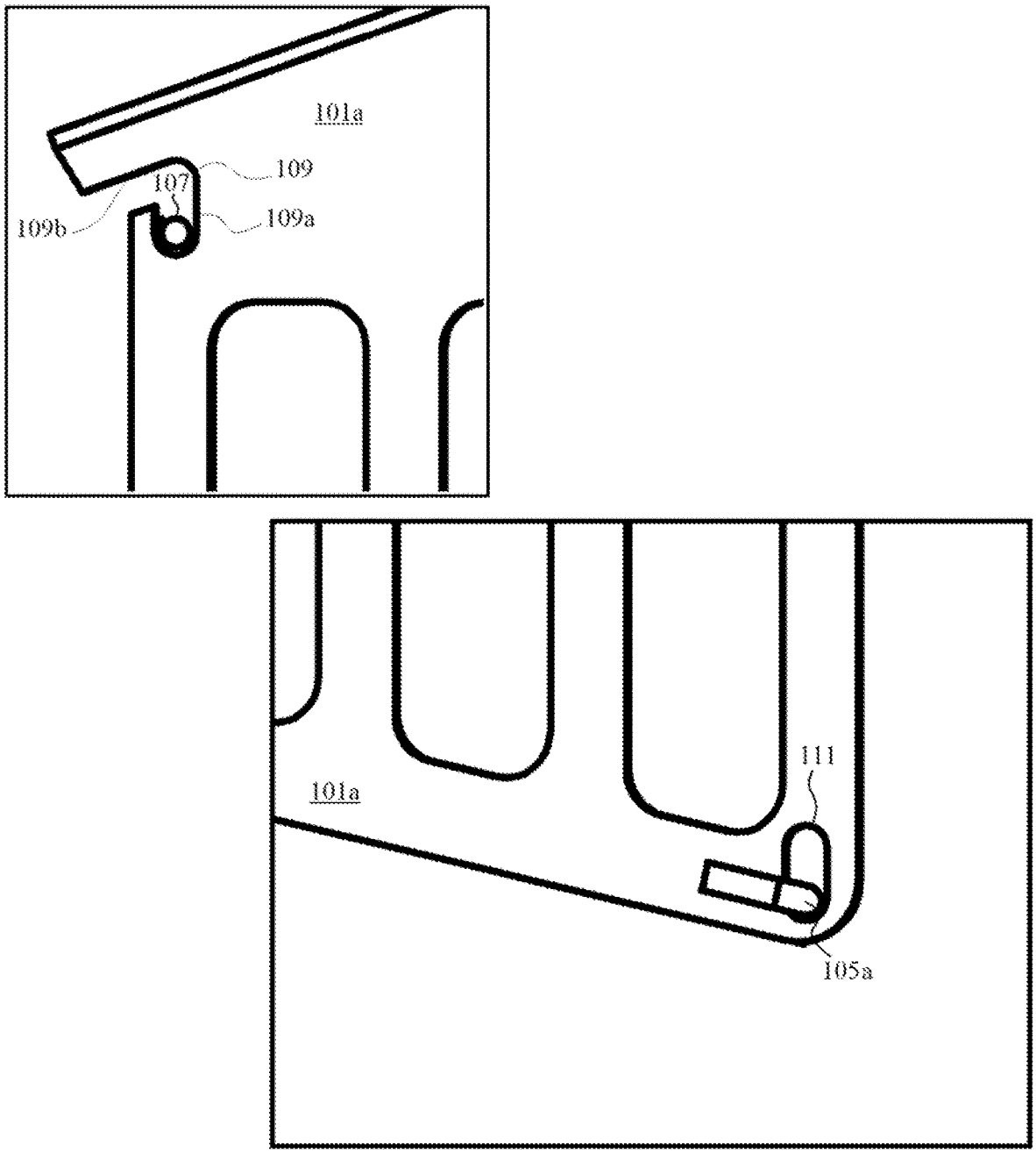
FIG. 8A is a close up view of the engagement structure and the hinge structure of the embodiment of FIG. 1, shown in the closed position.
Figure 8B:
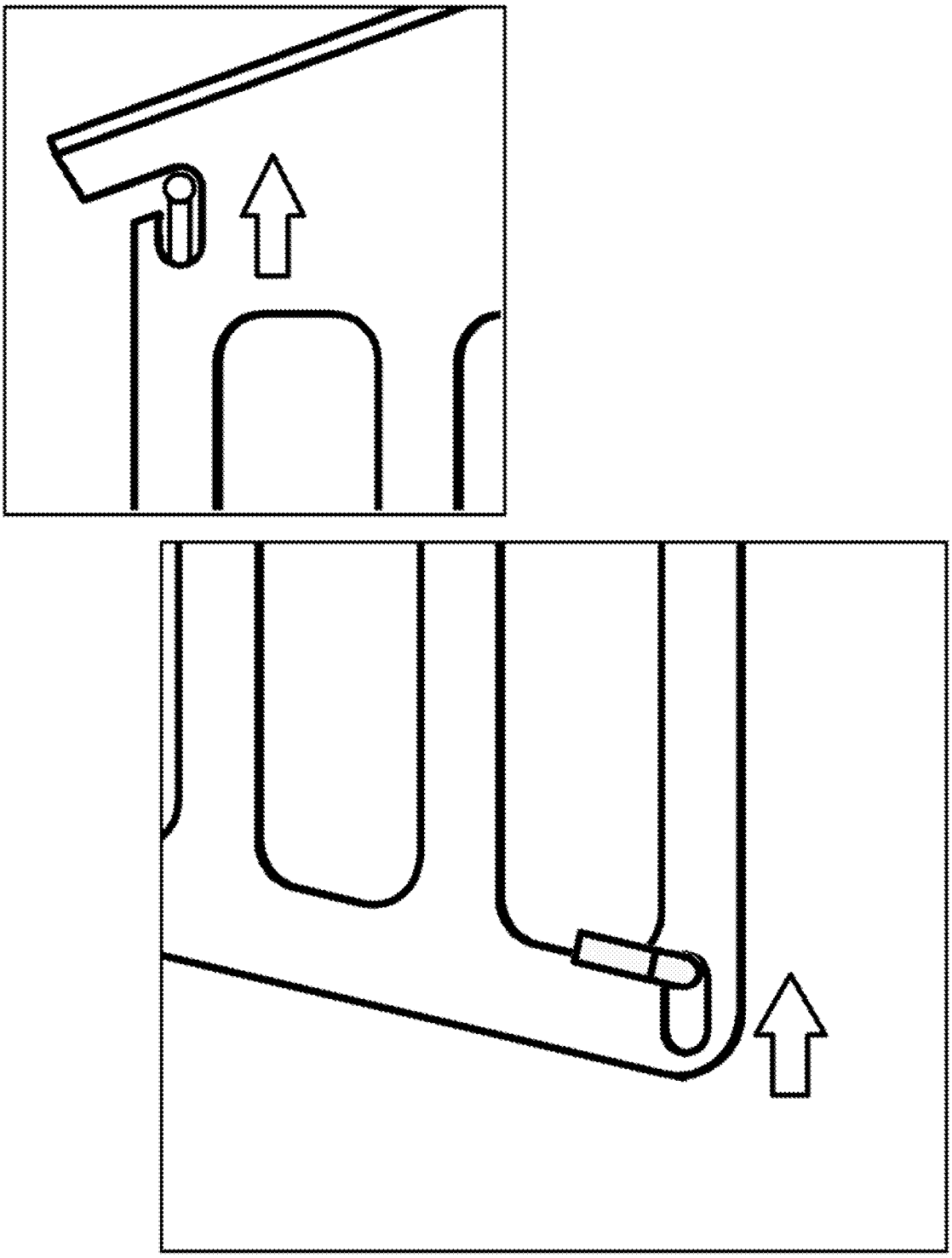
FIG. 8B is a close up view of the engagement structure and the hinge structure of the embodiment of FIG. 1, shown in a lifted position.
Figure 8C:
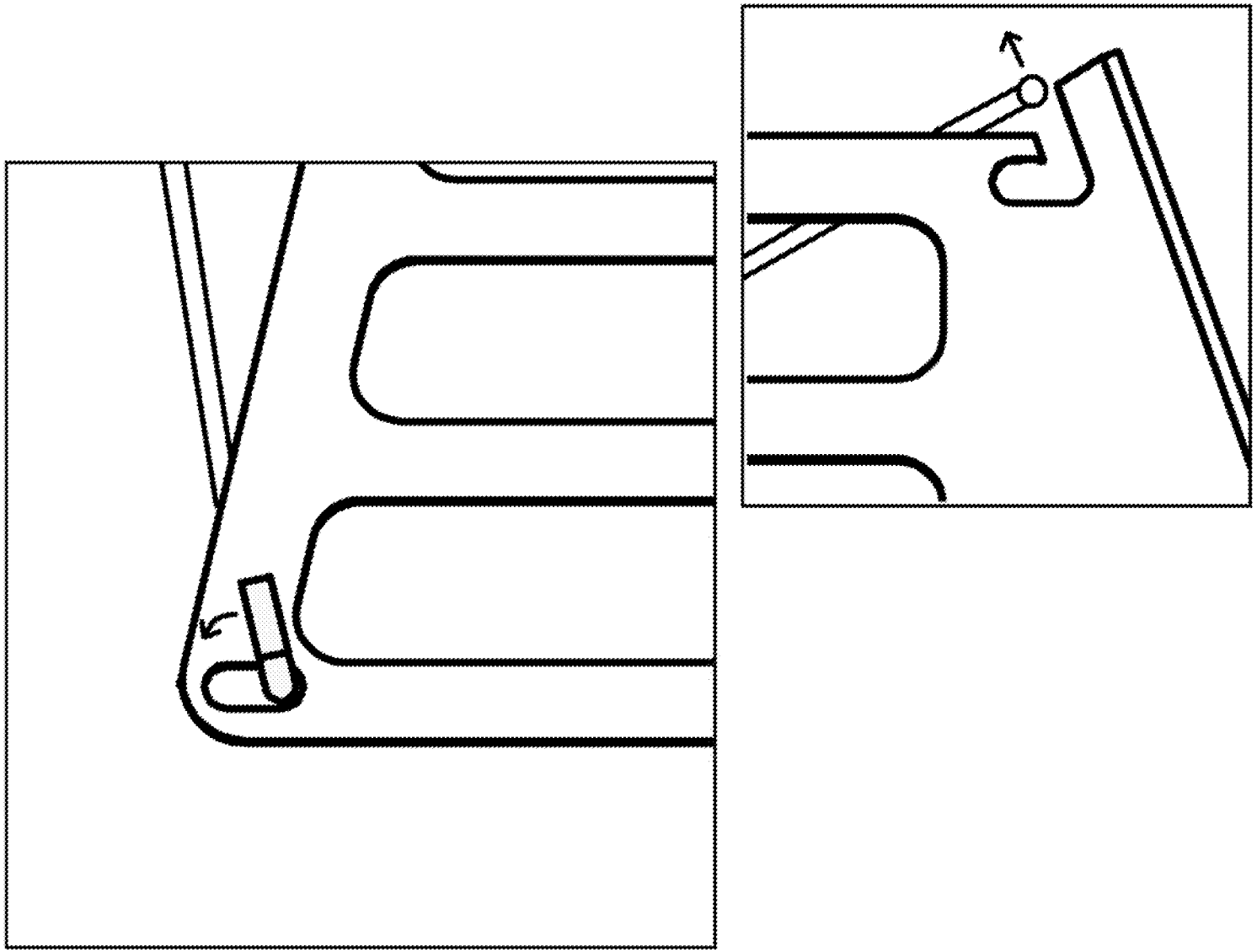
FIG. 8C is a close up view of the engagement structure and the hinge structure of the embodiment of FIG. 1, shown in a rotated position toward an open position.

The hinged portion 105 of the cage 103 can also slidable relative to the stationary frame 101 to allow the entire cage 103 to slide relative to the stationary frame 101 to disengage the cage 103 from the stationary frame 101 for example (e.g., as shown in FIGS. 8A, 8B, and 8C). The stationary frame 101 can be structured such that the engagement structure 107 of the cage 103 is configured to be freed from the stationary frame 101 by sliding the cage 101 in a first direction (e.g., up as shown in FIG. 8B), then rotating the cage 101 about the hinged portion 105 (e.g., as shown in FIG. 8C).

The stationary frame 101 can include a first side 101*a* and a second side 101*b*. The cage 103 can form a front and a bottom of the vent guard, e.g., as shown. As best shown in FIGS. 8A-8C, each side 101*a*, 101*b* can include an engagement slot 109 defined therein having an elbow shape and configured to receive the engagement structure 107 of the cage 103. Each side 101*a*, 101*b* can also include a hinge slot 111 defined therein having a straight shape, and configured to receive the hinge structure 105.

Each engagement slot 109 can include a first slot portion 109*a* extending substantially vertical and a second slot portion 109*b* extending substantially forward from the first slot portion to open to a front of each side. As shown, each second slot portion 109*b* can be angled downward from a top of the first slot portion 109*a* toward the front of each side 101*a*, 101*b*.

The hinge slot 111 can be a single slot that is substantially vertical such that the hinge structure 105 of the cage 103 can slide substantially vertically within the hinge slot 111 as well as rotate within the hinge slot 111 (e.g., as shown in FIGS. 8B and 8C). Each hinge slot 111 can be located at a diagonally opposite corner of each side 101*a*, 101*b* relative to the engagement slot 109. For example, as shown, each engagement slot 109 can be located in an upper front corner of each side 101*a*, 101*b* and each hinge slot 111 can be located in a lower rear corner of each side 101*a*, 101*b*.

The engagement structure 107 of the cage can include a lateral protrusion 107*a*, 107*b* for each engagement slot 109. As shown, each lateral protrusion 107*a*, 107*b* can extend laterally from the cage 103 and be configured to slide within a respective engagement slot 109 to engage and disengage the cage 103 with the stationary frame 101. As shown, in certain embodiments, the engagement structure 107 can be a bar attached extending across a width of the cage 103 (e.g., such that lateral protrusions 107*a*, 107*b* are the lateral ends of the bar that are wider than that distance between the sides 101*a*, 101*b*). As shown, the protrusions 107*a*, 107*b* act as pin sliders within the engagement slot to limit a path of motion of the cage 103 and to support the weight of the cage 103 in the closed position (e.g., as shown in FIGS. 1-8A). Any other suitable engagement structure having any suitable number of components, shape, or protrusions is contemplated herein.

The hinge structure 105 can include a hinge protrusion 105*a*, 105*b* disposed through each hinge slot 111 that extends both laterally and axially from each respective side 101*a*, 101*b* such that each hinge protrusion 105*a*, 105*b* prevents lateral removal of the cage 103 from each hinge slot 111. In certain embodiments, the hinge structure 105 can be a bar extending across a width of the cage 103. In certain embodiments, the engagement structure 107 is a top front bar attached to a plurality of cage bars 113, and the hinge structure 105 is a bottom rear bar attached to the plurality of cage bars 113. Any other suitable structure and/or position thereof to allow sliding and rotating of the cage 103 is contemplated herein.

The stationary structure 101 can include a slanted roof 115 (e.g., a rain guard) connecting the first side 101*a* and the second side 101*b* together. Any other suitable structure is contemplated herein (e.g., one or more mounting flanges defining screw holes as shown, etc.).

Referring to FIGS. 8A-8C, a method can include lifting a cage of a vent guard to slide the cage relative to a fixed structure of the vent guard and rotating the cage of the vent guard relative to the fixed structure to provide access to a vent. Lifting the cage can include lifting the cage at least partially vertically. Rotating the cage can include rotating the cage forward and downward. The method can include performing vent maintenance after opening the cage. The method can include any other suitable method(s) and/or portions thereof.

Embodiments can be utilized for dryer vents, bathroom exhausts, kitchen exhausts, and air intakes. Any other suitable vents and/or applications for the embodiments disclosed are contemplated herein.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A vent guard, comprising:

a stationary frame; and a cage hinged to the stationary frame at a hinged portion, wherein the cage is configured to engage to the stationary frame at an engagement structure of the cage to support the cage in a closed position to enclose a vent within the cage, wherein the engagement structure is configured to be slid relative to the stationary frame, wherein the stationary frame includes a first side and a second side and forms a first sidewall and a second sidewall of the vent guard and wherein the cage forms only a front and a bottom of the vent guard, wherein each of the first side and the second side comprises:

an engagement slot defined therein having an elbow shape and configured to receive the engagement structure of the cage; and a hinge slot defined therein having a straight shape, and configured to receive the hinge structure.

2. The vent guard of claim 1, wherein the hinged portion of the cage is also slidable relative to the stationary frame to allow the entire cage to slide relative to the stationary frame to disengage the cage.

3. The vent guard of claim 2, wherein the stationary frame is structured such that the engagement structure of the cage is configured to be freed from the stationary frame by sliding the cage in a first direction, then rotating the cage about the hinged portion.

4. The vent guard of claim 1, wherein each engagement slot includes a first slot portion extending substantially vertical and a second slot portion extending substantially forward from the first slot portion to open to a front of each side.

5. The vent guard of claim 4, wherein each second slot portion is angled downward from a top of the first slot portion toward the front of each side.

6. The vent guard of claim 5, wherein the hinge slot is a single slot that is substantially vertical such that the hinge structure of the cage can slide substantially vertically within the hinge slot as well as rotate within the hinge slot.

7. The vent guard of claim 6, wherein each hinge slot is located at a diagonally opposite corner of each side relative to the engagement slot.

8. The vent guard of claim 7, wherein each engagement slot is located in an upper front corner of each side and each hinge slot is located in a lower rear corner of each side.

9. The vent guard of claim 8, wherein the engagement structure of the cage includes a lateral protrusion for each engagement slot, each lateral protrusion extending laterally from the cage and configured to slide within a respective engagement slot to engage and disengage the cage with the stationary frame.

10. The vent guard of claim 9, wherein the engagement structure is a bar attached extending across a width of the cage.

11. The vent guard of claim 10, wherein the hinge structure includes a hinge protrusion disposed through each hinge slot that extends both along a hinge axis from each respective side through the respective engagement slot and at an angle relative to the axis along the first side and the second side such that each hinge protrusion prevents lateral removal of the cage from each hinge slot.

12. The vent guard of claim 11, wherein the hinge structure is a bar extending across a width of the cage.

13. The vent guard of claim 12, wherein the engagement structure is a top front bar attached to a plurality of cage bars, and the hinge structure is a bottom rear bar attached to the plurality of cage bars.

14. The vent guard of claim 13, wherein the stationary structure includes a slanted roof connecting the first side and the second side together.

* * * * *